US011280014B2

(12) United States Patent
Xu et al.

(10) Patent No.: US 11,280,014 B2
(45) Date of Patent: Mar. 22, 2022

(54) SILVER/TIN ELECTROPLATING BATH AND METHOD OF USING THE SAME

(71) Applicant: MacDermid Enthone Inc., Waterbury, CT (US)

(72) Inventors: Fengting Xu, Bethany, CT (US); Jean W. Chevalier, Waterbury, CT (US); Ernest Long, Burlington, CT (US); Richard A. Bellemare, Watertown, CT (US); Michael M. Ryl, Juechen (DE)

(73) Assignee: MacDermid Enthone Inc., Waterbury, CT (US)

( * ) Notice: Subject to any disclaimer, the term of this patent is extended or adjusted under 35 U.S.C. 154(b) by 0 days.

(21) Appl. No.: 16/893,956

(22) Filed: Jun. 5, 2020

(65) Prior Publication Data

US 2021/0381121 A1 Dec. 9, 2021

(51) Int. Cl.

| | |
|---|---|
| ***C25D 3/46*** | (2006.01) |
| ***C25D 3/32*** | (2006.01) |
| ***C25D 5/12*** | (2006.01) |
| ***H01R 43/26*** | (2006.01) |

(52) U.S. Cl.

CPC ..... *C25D 3/46* (2013.01); *C25D 3/32* (2013.01); *C25D 5/12* (2013.01); *H01R 43/26* (2013.01)

(58) Field of Classification Search

None

See application file for complete search history.

(56) References Cited

U.S. PATENT DOCUMENTS

| | | | | |
|---|---|---|---|---|
| 5,902,472 | A * | 5/1999 | Arai | H01L 23/49866 205/125 |
| 7,713,859 | B2 | 5/2010 | Richardson et al. | |
| 9,512,529 | B2 | 12/2016 | Foyet et al. | |
| 2002/0187364 | A1* | 12/2002 | Heber | C25D 3/60 428/648 |
| 2010/0116674 | A1* | 5/2010 | Luo | C25D 21/18 205/101 |
| 2014/0299351 | A1* | 10/2014 | Moser | H01B 7/0009 174/110 SR |
| 2014/0353162 | A1* | 12/2014 | Foyet | H01L 24/11 205/122 |
| 2017/0149191 | A1 | 5/2017 | Horn et al. | |
| 2019/0309429 | A1* | 10/2019 | Kienle | H01L 21/2885 |

FOREIGN PATENT DOCUMENTS

| | | |
|---|---|---|
| EP | 3004429 | 7/2018 |

* cited by examiner

*Primary Examiner* — Wojciech Haske

(74) *Attorney, Agent, or Firm* — Carmody Torrance Sandak & Hennessey LLP

(57) ABSTRACT

An electroplating bath for depositing a silver/tin alloy on a substrate. The electroplating bath comprises (a) a source of tin ions; (b) a source of silver ions; (c) an acid; (d) a first complexing agent; (e) a second complexing agent, wherein the second complexing agent is selected from the group consisting of allyl thioureas, aryl thioureas, and alkyl thioureas, and combinations thereof; and (f) optionally, a wetting agent, and (g) optionally, an antioxidant.

18 Claims, 9 Drawing Sheets

SILVER/TIN ELECTROPLATING BATH AND METHOD OF USING THE SAME

FIELD OF THE INVENTION

The present invention relates generally to an electroplating bath containing silver and tin ions and methods of electroplating silver/tin alloys using the electroplating bath. More specifically, the present invention relates generally to a silver/tin electroplating bath having improved stability.

BACKGROUND OF THE INVENTION

There are two categories of silver and tin alloys. The first category comprises silver-based or silver-rich silver/tin alloys having a silver content of more than about 50%. These alloys possess higher hardness and higher wear resistance as compared to pure silver and are commonly used in decorative applications. Due to their excellent electrical conductivity they have also been suggested for use in electronic connectors to reduce the amount of hard gold that is used as a contact material finish due to its good wear and corrosion resistance.

While hard gold provides a low electrical contact resistance required for charge transport, the price of gold can be a limiting factor for low cost contact finishes. Therefore silver/tin alloys have been suggested for use as connector finishes to replace or reduce the amount of hard gold. One traditional method of producing these silver/tin alloys includes plating one or more alternating layers of silver and tin followed by diffusion in a non-oxidizing atmosphere to form the silver/tin alloy.

Another type of electrical connection is a press-fit connection, which is a contact terminal that is pressed into a printed circuit board (PCB) or other similar substrate. Press-fit pins are designed with a compliant zone and plated with a suitable deposit. Once press-fitted into a through-hole of a PCB, the press fit pin maintains a force normal to the hole wall. In other words, compliant press fit pins have formed features that create gas-tight joints by acting as springs pressing outward against the barrel of a plated through-hole. The coating on both the press-fit pin and the hole wall forms a gas tight cold weld joint. This connection is suitable for use in tough environments, such as automotive environments.

Advantages of press fit connections include that it is a solderless process, eliminating the need for solder paste printing and preheating. This also eliminates soldering defects such as bridging, poor wetting, flux residues, and cold solder joints. Because no heating is involved, no thermal stress is added to the PCB, and lower cost standard resins can be used instead of heat stabilized resins. Press fit connections also allow for fast, flexible processing and are environmentally friendly.

Currently press fit pins or connection are mostly plated with tin and or a SnPb alloy. The base material is typically a bronze alloy (i.e., copper and tin). This base material is plated with a nickel barrier layer to prevent migration of copper/alloying elements, for example, with a nickel sulfamate based plating system to a thickness of about 1-3 μm. Thereafter, the nickel barrier layer is plated with the tin or tin/lead alloy.

SnPb is commonly used as a plated finish for automotive press fit applications because it is easy to apply and has a lower propensity to whisker. However, due to environmental concerns, lead is banned in many instances. Pure tin is also used but has a high tendency to whisker under press fit stress. Deformation of the deposit during insertion creates stresses within the deposit that provide the driving force for whisker growth. Thus, there is a need for an alternative whisker-resistant plating material that can provide a whisker resistant connector finish.

Difficulties associated with co-deposition of lead-free tin alloys by electroplating arise when the materials being deposited have significantly different deposition potentials. Complications can arise, for example, when attempting to deposit alloys of tin (−0.137 V) with silver (0.799 V).

It is also desirable that the composition of the deposits be effectively controlled to prevent melting of the material at too high or too low a temperature for a given application. Poor control of the composition can result in either temperatures that are too high for the components being treated to withstand or, on the other extreme, result in incomplete formation of the solder joint.

AgSn alloy coatings have been suggested as alternatives to pure tin and SnPb alloys, especially for use as plated finishes in automotive press fit applications. The benefits to an AgSn alloy include the potential for no free tin, eliminating whisker issues and no free silver, eliminating electromigration issues. Thus, it would be desirable to produce an 80/20 Ag/Sn alloy ratio from a silver/tin electroplating bath that can overcome the deficiencies of the prior art.

However, there are a number of challenges related to the AgSn electrolyte. For example, there are large reduction potentials between the various metals. In addition, spontaneous reactions can occur in complex-free AgSn electrolyte solutions. Finally, such electrolyte solutions are very unstable, leading to uncontrolled immersion deposition and precipitation as well as poor alloy control.

Accordingly, there remains a need in the art for a stable electroplating bath that can deposit silver-rich silver/tin alloys, for use, for example in replacing hard gold.

Pure silver complexing agents such as 5,5-dimethylhydantoin and rhodadine are not stable in an acidic environment and are thus only typically applicable in alkaline-based electrolytes. In addition, compounds such as succinimide, 2-aminothiazole, picolinic acid, 2-mercapto-1-methylimidazole, and 2-thiazoline-2-thiol were found not to yield a stable electrolyte. In addition, these compounds also did not bring down the potential of silver, which is necessary to maintain solution stability with the coexistence of stannous tin.

U.S. Pat. No. 9,512,529 to Foyet et al., the subject matter of which is herein incorporated by reference in its entirety, describes silver and tin alloy electroplating baths including complexing agents that enable electrodeposition of either silver rich or tin rich alloys. The complexing agents include specific compounds having the formula:

X—S—Y where X and Y may be substituted or unsubstituted phenol groups, HO—R— or —R'—S—R"—OH with the proviso that when X and Y are the same they are substituted or unsubstituted phenol groups otherwise X and Y are different and wherein R, R' and R" are the same or different and are linear or branched alkylene radicals having 1 to 20 carbon atoms; along with one or more compounds having a formula:

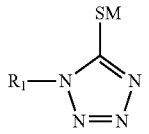

where M is hydrogen, $NH_4$, sodium or potassium and $R_1$ is substituted or unsubstituted, linear or branched ($C_2$-$C_{20}$) alkyl, substituted or unsubstituted ($C_6$-$C_{10}$)aryl. This electrolyte uses 1-(2-dimethylaminoethyl)-5-mercapto-1,2,3,4-tetrazole as a secondary complexing agent.

The inventors have found that it is difficult to electroplate silver and tin (especially in a desired alloy content of greater than about 75 atomic ratio silver/tin) in an electrolyte using these types of complexing agents due to the large Redox potential difference between silver and tin. Both silver and tin ions in the electrolyte solutions are unstable and various complexing agents are required to keep the silver and tin ions stable in the electrolyte. However, the complexing agents tend to become ineffective during electrolysis. In addition, breakdown products of the complexing agents can cause poor appearance of the electroplated AgSn alloy and inconsistent alloy composition. Based thereon, it is not believed that the described complexing agents would be able to maintain solution stability during the electrolysis process.

Thus, there remains a need in the art for a stable electrolyte that is capable of consistently delivering a uniform matte white AgSn deposit in a desired alloy composition range of 70-90% silver (atomic ratio silver/tin). In addition, there remains a need in the art for a stable electrolyte that contains suitable complexing agents in suitable amounts such that the complexing agents do not become ineffective during electrolysis.

In addition, there remains a need in the art for a stable electrolyte that can provide a whisker resistant connector finish on press fit pins, especially press fit pins used in automotive applications, as well as other connectors.

SUMMARY OF THE INVENTION

It is an object of the present invention to provide an electroplating bath for depositing silver-rich alloys on the surface of a substrate.

It is another object of the present invention to provide a stable electroplating bath that is capable of electroplating silver tin alloys having a consistent alloy ratio of about 70-90% silver (atomic ratio silver/tin/) in the alloy.

It is still another object of the present invention to provide a stable tin silver electroplating bath comprising complexing agents that remain effective during electrolysis over time.

It is still another object of the present invention to provide a plated tin silver deposit having a high silver content (i.e., greater than about 75% silver (atomic ratio silver/tin) that has a uniform appearance and consistent alloy composition over a wide current density operating range.

It is still another object of the present invention to provide a silver/tin alloy electroplating bath that is at least substantially free of lead.

It is still another object of the present invention to provide a silver/tin alloy electroplating bath that is capable of providing a whisker resistant connector finish on connectors, such as press fit pins.

To that end, in one embodiment, the present invention relates generally to a silver/tin alloy electroplating bath comprising:

A) silver ions;

B) tin ions;

C) an acid;

D) a first complexing agent;

E) a second complexing agent wherein the second complexing agent is selected from the group consisting of allyl thioureas, aryl thioureas, and alkyl thioureas, and combinations thereof;

F) optionally, a wetting agent; and

G) optionally, an antioxidant.

BRIEF DESCRIPTION OF THE FIGURES

The present invention will now be illustrated with reference to following figures in which.

DETAILED DESCRIPTION OF THE PREFERRED EMBODIMENTS

Figure 1:
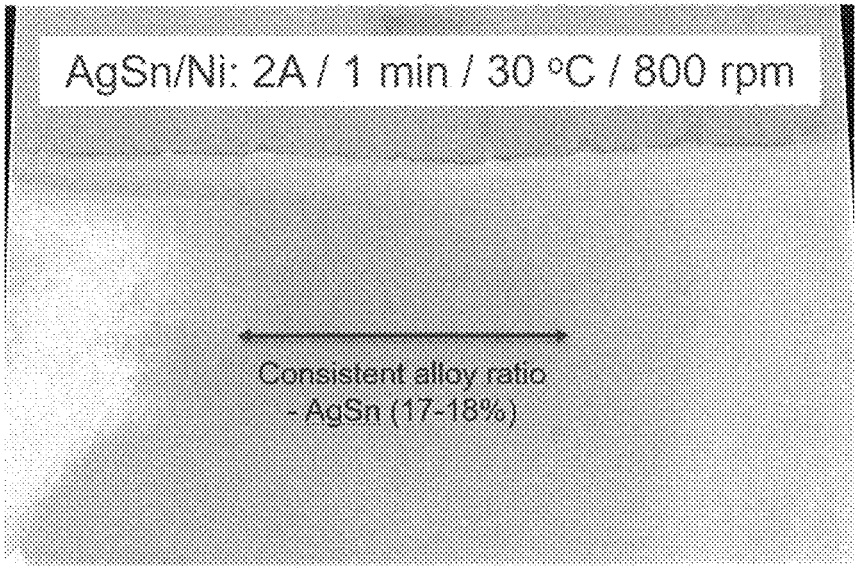
FIG. 1 depicts a view of a silver/tin alloy deposited on a nickel substrate in accordance with Example 1.

The inventors of the present invention have discovered that a specific combination of complexing agents can be used to produce a stable silver/tin alloy deposit on a substrate that has a high silver content and that exhibits a uniform appearance and consistent alloy composition over a wide current density range. In addition the combination of complexing agents described herein also produces an improved silver/tin alloy deposit on a connector, such as a press fit pin, that is whisker resistant.

As used herein, "a," "an," and "the" refer to both singular and plural referents unless the context clearly dictates otherwise.

As used herein, the term "about" refers to a measurable value such as a parameter, an amount, a temporal duration, and the like and is meant to include variations of +/−15% or less, preferably variations of +/−10% or less, more preferably variations of +/−5% or less, even more preferably variations of +/−1% or less, and still more preferably variations of +/−0.1% or less of and from the particularly recited value, in so far as such variations are appropriate to perform in the invention described herein. Furthermore, it is also to be understood that the value to which the modifier "about" refers is itself specifically disclosed herein.

As used herein, spatially relative terms, such as "beneath", "below", "lower", "above", "upper" and the like, are used for ease of description to describe one element or feature's relationship to another element(s) or feature(s) as illustrated in the figures. It is further understood that the terms "front" and "back" are not intended to be limiting and are intended to be interchangeable where appropriate.

As used herein, the terms "comprises" and/or "comprising," specify the presence of stated features, integers, steps, operations, elements, and/or components, but do not preclude the presence or addition of one or more other features, integers, steps, operations, elements, components, and/or groups thereof.

As used herein the term "substantially-free" or "essentially-free" if not otherwise defined herein for a particular element or compound means that a given element or compound is not detectable by ordinary analytical means that are well known to those skilled in the art of metal plating for bath analysis. Such methods typically include atomic absorption spectrometry, titration, UV-Vis analysis, secondary ion mass spectrometry, and other commonly available analytically methods.

In one embodiment, the present invention relates generally to a silver/tin alloy electroplating bath comprising:

A) silver ions;

B) tin ions;

C) an acid;

D) a first complexing agent;

E) a second complexing agent, wherein the second complexing agent is selected from the group consisting of allyl thioureas, aryl thioureas, and alkyl thioureas, and combinations thereof;

F) optionally, a wetting agent; and

G) optionally, an antioxidant.

The electroplating baths of the present invention include one or more sources of silver ions. Sources of silver ions may be provided by silver salts such as, but are not limited to silver halides, silver gluconate, silver citrate, silver lactate, silver nitrate, silver sulfates, silver alkane sulfonates and silver alkanol sulfonates. When a silver halide is used, it is preferable that the halide is chloride. Preferably the silver salts are silver sulfate, a silver alkane sulfonate or mixtures thereof, and more preferably silver sulfate, silver methane sulfonate or mixtures thereof. In one particularly preferred embodiment, the silver ions are provided by silver methane sulfonate. However, the present invention is not limited to silver methane sulfonate and other water-soluble silver salts, including the silver salts listed above may be used in practice of the instant invention.

The amounts of the one or more silver salts used in the baths depend, for example, on the desired alloy composition to be deposited and operating conditions. For producing a silver-rich deposit, in general, the concentration of the silver salts in the bath may range from about 0.1 g/L to about 100 g/L, more preferably from about 2 g/L to about 80 g/L, even more preferably from about 5 to about 60 g/L.

The electroplating baths include one or more sources of tin ions. Sources of tin ions include, but are not limited to salts, such as tin halides, tin sulfates, tin alkane sulfonates, tin alkanol sulfonates, and acids. When tin halide is used, it is typical that the halide is chloride. Preferably, the tin salt is tin sulfate, tin chloride or a tin alkane sulfonate, and more preferably tin sulfate or tin methane sulfonate. In one particularly preferred embodiment, the tin ions are provided by tin methane sulfonate. However, the present invention is not limited to tin methane sulfonate and other water-soluble tin salts, including the tin salts listed above may be used in practice of the instant invention.

The amount of the one or more tin salts used in the bath depends on the desired composition of the alloy to be deposited and operating conditions. In general, tin salts in the electroplating bath of the invention may range from about 1 g/L to about 100 g/L, more preferably from about 2 g/L to about 80 g/L, even more preferably from about 5 to about 50 g/L.

Any aqueous soluble acid which does not otherwise adversely affect the bath may be used in the electroplating bath described herein. Suitable acids include, but are not limited to, aryl sulfonic acids, alkane sulfonic acids, such as methane sulfonic acid, ethane sulfonic acid and propane sulfonic acid, aryl sulfonic acids such as phenyl sulfonic acid and tolyl sulfonic acid, and inorganic acids such as sulfuric acid, sulfamic acid, hydrochloric acid, hydrobromic acid and fluoroboric acid. In one preferred embodiment the acid that is used for the silver complex and/or tin complex is used. Thus, if silver methane sulfonate is used as the source of silver ions and tin methane sulfonate as the source of tin ions, the preferred acid would be methane sulfonic acid. In addition, although a mixture of acids may be used, more typically only a single acid is used.

Depending on the desired alloy composition and operating conditions, the amount of acid in the electrolyte compositions may be in the range of about 1 to about 500 g/L, more preferably from about 10 to about 400 g/L, even more preferably from about 20 to about 200 g/L.

As discussed above, prior art AgSn bath electrolyte solutions have a tendency to be very unstable, causing uncontrolled immersion deposition and precipitation and poor alloy control. Thus, the inventors of the present invention determined that unique complexing agents are required to regulate the electro-deposition process and prevent spontaneous immersion deposition and precipitation. In addition, the complexing agents must also be stable and effective over long time periods.

Based thereon, the inventors of the present invention surprisingly discovered that the use of the combination of the first complexing agent and the second complexing agent described herein produces an improved result. It is believed that one complexing agent reduces the potential of silver to keep both $Ag^{+}$ and $Sn^{2+}$ stable in the electrolyte and the other complexing agent facilitates plating consistency, including grain structure, alloy composition, and the like.

2,2'-thiodiethanol and 3,6-dithia-1,8-octane diol have been found to be good silver complexing agents in acidic environments. However, the inventors found that a secondary complexing agent was also needed to prevent and/or minimize silver immersion on the substrate and during AgSn plating.

In one embodiment, the first complexing agent is a dihydroxy bis-sulfide compound have the following general formula:

$$HO—R—S—R'—S—R''—OH$$

wherein R, R' and R'' are the same or different and are linear or branched alkylene radicals having from 1 to 20 carbon atoms, preferably from 1 to 10 carbon atoms, more preferably R and R" have 2 to 10 carbon atoms and R' has 2 carbon atoms.

Examples of these dihydroxy bis-sulfide compounds include, but are not limited to, 2,4-dithia-1,5-pentanediol, 2,5-dithia-1,6-hexanediol, 2,6-dithia-1,7-heptanediol, 2,7-dithia-1,8-octanediol, 2,8-dithia-1,9-nonanediol, 2,9-dithia-1,10-decanediol, 2,11-dithia-1,12-dodecanediol, 5,8-dithia-1,12-dodecanediol, 2,15-dithia-1,16-hexadecanediol, 2,21-dithia-1,22-doeicasanediol, 3,5-dithia-1,7-heptanediol, 3,6-dithia-1,8-octanediol, 3,8-dithia-1,10-decanediol, 3,10-dithia-1,8-(dodecanediol, 3,13-dithia-1,15-pentadecanediol, 3,18-dithia-1,20-eicosanediol, 4,6-dithia-1,9-nonanediol, 4,7-dithia-1,10-decanediol, 4,11-dithia-1,14-tetradecanediol, 4,15-dithia-1,18-octadecanediol, 4,19-dithia-1,22-dodeicosanediol, 5,7-dithia-1,1'-undecanediol, 5,9-dithia-1,13-tridecanediol, 5,13-dithia-1,17-heptadecanediol, 5,17-dithia-1,2'-uneicosanediol, 1,8-dimethyl-3,6-dithia-1,8-octanediol, and combinations of one or more of the forgoing. In one preferred embodiment, the first complexing agent comprises 3,6-dithia-1,8-octanediol.

In another embodiment, the first complexing agent may comprise thiodiglycol, imides, such as succinimide, cystine, heterocyclic organic compounds including heterocyclic amines such as 2-aminothiazole and aromatic heterocyclic organic compounds such as 2-mercapto-1-methylimidazole. In one preferred embodiment, the first complexing agent comprises thiodiglycol.

It is further noted that any of these first complexing agents may be used alone or in combination with each other. That is, in one embodiment, the first complexing agent comprises, more preferably consists of one of the listed first complexing agents. In an alternative embodiment, the first complexing agent comprises a mixture of two or more of the listed complexing agents.

The first complexing agent is preferably present in the tin/silver electroplating bath in an amount of between about 1 to about 300 g/L, more preferably about 20 to about 250 g/L, even more preferably in an amount of between about 50 to about 200 g/L.

The second complexing agent is preferably a thiourea, more preferably a thiourea selected from the group consisting of allyl thioureas, aryl thioureas, and alkyl thioureas, and combinations thereof. Examples of allyl thioureas, aryl thioureas, and alkyl thioureas used in the practice of the present invention include, but are not limited to, N-Allyl-N'-(2-hydroxyethyl)thiourea, Allyl-thiourea, phenylthiourea, N,N'-dimethylthiourea, and combinations of one or more of the foregoing. Other similar ally thioureas, aryl thioureas and alkyl thioureas are also usable in the present invention and would be known to those skilled in the art. The second complexing agent is preferably present in the tin/silver electroplating bath in an amount of between about 0.1 to about 100 g/L, more preferably about 0.5 to about 50 g/L, even more preferably in an amount of between about 2 to about 20 g/L.

Optionally, but preferably, one or more antioxidants may be added to the bath such as, for example, pyrocatechol, resorcinol, and hydroquinone sulfonic acid or a salt thereof such as hydroquinone sulfonic acid, potassium salt. In one embodiment, the silver/tin plating bath comprises pyrocatechol as the antioxidant. When an antioxidant is used, the concentration of the reducing agent in the bath may be between about 0.01 to 20 g/L, more preferably between about 0.1 to about 5 g/L.

One or more antifoam agents, brighteners, surfactants, grain refiners, etc. may also be included in the tin/silver electroplating composition. In addition, in one embodiment, the composition described herein may include a polyalkylene glycol to inhibit the formation or occurrence of small diameter pits in the plated deposit.

For applications requiring good wetting capabilities, one or more surfactants may be included in the baths. Suitable surfactants are known to those skilled in the art, and include any which yield deposits having good solderability, good matte or lustrous finish where desired, satisfactory grain refinement, and are stable in the acidic electroplating baths. Preferred surfactants include low foaming surfactants, which may be used in conventional amounts. Examples of suitable surfactants include UCON™ 50-HB series surfactants (available from Dow Chemical, such as UCON 50-HB-100, by way example and not limitation. Other suitable surfactants include Lugalvan® BNO 12 (available from BASF).

The silver/tin electroplating baths are may be prepared by adding to a plating vessel the composition set forth above, along with one or more optional additives, and the balance water. In one embodiment, the first complexing agent and the second complexing agent are added to the plating vessel prior to adding the soluble silver and tin compounds. Once the aqueous bath is prepared, undesired material can be removed, such as by filtration and then water may be added to adjust the final volume of the bath. The bath may be agitated by known means, such as stirring, pumping, or recirculating, for increased plating speed.

In one preferred embodiment, the baths is acidic, generally having a pH of less than about 7, more typically from less than or equal to 2 to about 3.

The electroplating baths described herein are useful in many plating methods where a silver/tin alloy is desired and are low foaming. Plating methods include, but are not limited to horizontal or vertical wafer plating, barrel plating, rack plating and high speed plating such as reel-to-reel and jet plating. A silver/tin alloy may be deposited on a substrate by the steps of contacting the substrate with the bath and passing a current through the bath to deposit the silver/tin alloy on the substrate. Substrates which may be plated include, but are not limited to, copper, copper alloys, nickel, nickel alloys, brass containing materials, electronic components, such as electrical connectors, and semiconductor wafers such as silicon wafers. The baths may be used for electroplating of electronic components, such as electrical connectors, jewelry, decoratives, and interconnect bump plating applications. The substrate may be contacted with the bath in any manner known in the art.

Current density used to plate the silver and tin alloys depends on the particular plating process and requirement. Generally, the current density is 0.05 A/dm$^2$ or more or such as from 1 to 25 A/dm$^2$. Lower current densities range from 0.05 A/dm$^2$ to 10 A/dm$^2$. High current densities, such as in jet plating with high agitation, may exceed 10 A/dm$^2$ and may even be as high as 25 A/dm$^2$.

The silver/tin alloys may be electroplated at temperatures from room temperature to about 55° C., or from room temperature to about 45° C., or such as from room temperature to 40° C.

The baths may be used to deposit silver/tin alloys of various concentrations. When the alloy is a bright silver rich silver/tin alloy, the silver content may range from greater than 50% to about 95% silver (atomic ratio silver/tin), more preferably the silver content ranges from about 75% to about 95% silver (atomic ratio silver/tin).

In the case of tin rich alloys, the alloys may contain from greater than 50% tin to about 99% tin (atomic ratio tin/silver) with the remainder silver, more preferably from about 80% to about 99% tin (atomic ratio tin/silver). Such weights are based on measurements taken by either atomic adsorption spectroscopy ("AAS"), X-ray fluorescence ("XRF"), inductively coupled plasma ("ICP") or differential scanning calorimetry ("DSC"). For many applications, the eutectic composition of an alloy may be used.

In addition, it is also desirable that the tin/silver alloy electroplating baths described herein be at least substantially free of lead. By "substantially free of lead" what is meant is that the baths and the silver/tin alloy deposits contain 50 ppm or less of lead. In addition, the silver/tin alloy electroplating baths are also preferably free of cyanide. Cyanide is primarily avoided by not employing any silver or tin salts or other compounds in the baths which include the $CN^-$ anion.

In one embodiment, the silver/tin electroplating composition is configured to deposit a silver tin alloy on a substrate containing at least 50% silver, preferably at least 60% silver, more preferably at least 70% silver, even more preferably between 70% to 95% silver. In one preferred embodiment, the silver/tin electroplating composition is configured to deposit AgSn alloy having a consistent alloy ratio of about 17-18 wt. % tin. It is also desirable that the AgSn alloy exhibit a satin white deposit color.

In another preferred embodiment, the present invention also related generally to a method of electroplating a tin/silver alloy onto the surface of a substrate, the method comprising the steps of:

a) contacting the surface of the substrate with a silver/tin electroplating bath comprising:
   i) silver ions;
   ii) tin ions;
   iii) an acid;
   iv) a first complexing agent;
   v) a second complexing agent, wherein the second complexing agent is selected from the group consisting of allyl thioureas, aryl thioureas, and alkyl thioureas, and combinations thereof;
   vi) optionally, a wetting agent; and
   vii) optionally, an antioxidant;
   wherein the electroplating bath deposits a silver/tin alloy on the surface of the substrate.

Substrates that may be plated include, for example, copper, copper alloys, nickel, nickel alloys, brass containing materials, electronic components such as electrical connectors, and semiconductor wafer, including silicon wafers, and combinations of one or more of the foregoing. In one embodiment, the substrate comprises a stack of metal and/or metal alloy layers and the silver/tin alloy is deposited on the stack of metal/metal alloy layers. In other embodiments, the substrate may be an underlayer.

In one particularly preferred embodiment, the substrate comprises a connector such as a press fit pin, the connector optionally, but preferably, having a nickel barrier layer thereon, and the electrolyte is used to deposit AgSn alloy on the press fit pin or other connector.

The present invention will now be illustrated with reference to the following non-limiting examples:

Example 1

A silver/tin electroplating bath was prepared as set forth in Table 1:

TABLE 1

| Component | Amount |
|---|---|
| Silver ions (from silver methane sulfonate) | 40.0 g/L |
| Tin ions (from tin methane sulfonate) | 15.0 g/L |
| Methane sulfonic acid (70 wt. %) | 50 ml/L |

TABLE 1-continued

| Component | Amount |
|---|---|
| 3,6-dithiaoctane-1,8-diol | 150 g/L |
| N-Allyl-N'-(2-hydroxyethyl)thiourea | 6.6 g/L |
| Pyrocatechol | 1.65 g/L |
| UCON 50-HB-100 | 7.70 ml/L |
| Water | Balance |

AgSn was deposited on a nickel substrate at a current density of 5 ASD and a temperature of 30° C. for 1 minute and 800 rpm. The pH of the electroplating bath was 0.95. The plated deposit contained 82% silver.

The AgSn deposit exhibited a satin white appearance with very fine grains. The focused ion beam (FIB) sectioning showed a pore-free, close packed coating structure. No free tin was detected by XRD analysis in the AgSn deposit. Consistent alloy composition was observed across the operating current densities in the range of 17-18 wt. % tin as shown in FIG. 1.

Figure 2:
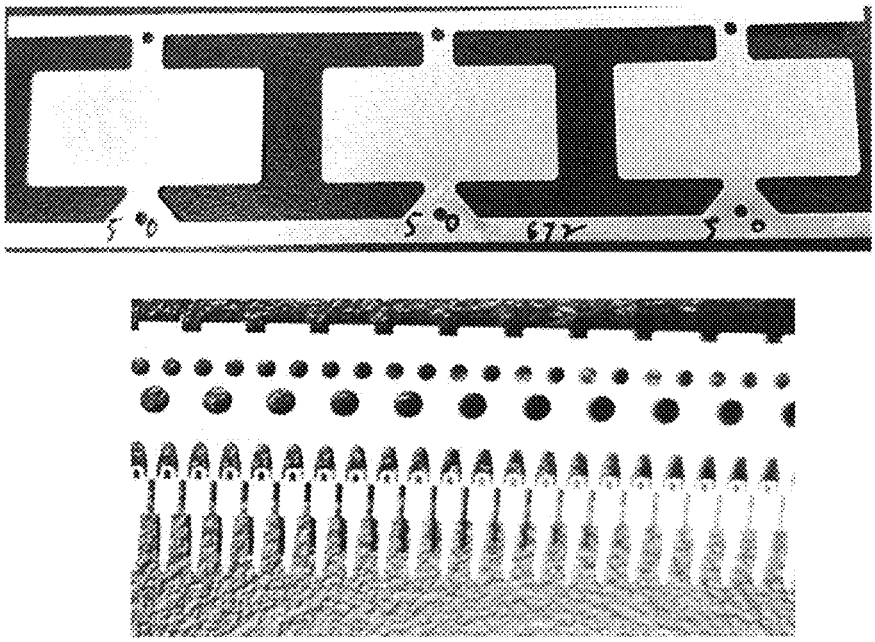
FIG. 2 depicts a view of the silver/tin alloy deposited on a nickel substrate in accordance with Example 1.

The silver/tin alloy exhibited a smooth appearance on the substrate as shown in FIG. 2.

Figure 3:
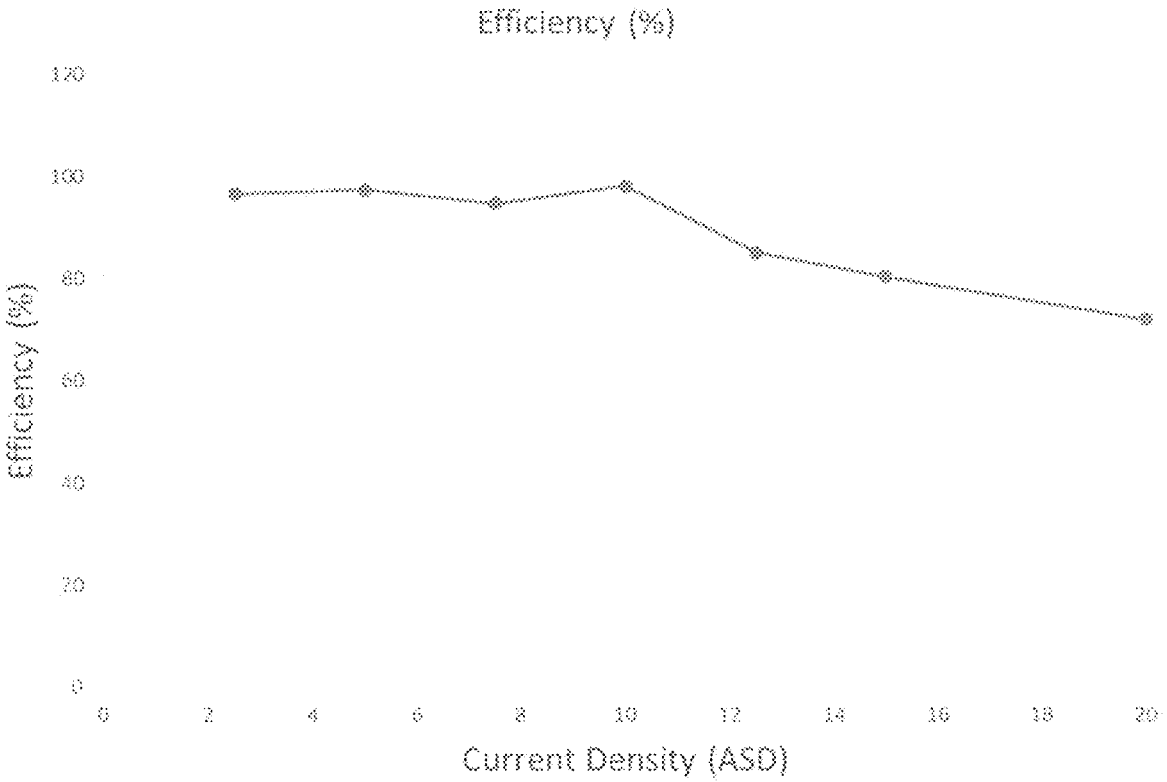
FIG. 3 depicts a graph of an efficiency test versus current density of the electroplating bath of Example 1.

The electrolyte maintained a high cathode efficiency from 2.5 A/dm$^2$ to 12.5 A/dm$^2$ as shown in FIG. 3.

An aging test was also performed by plating the AgSn alloy on a copper substrate with one liter of electrolyte. The plating was done at current densities between 5 to 7.5 ASD at 30-35° C. The electrolyte was agitated by magnetized stirring at 300 rpm with 5 cm stirring bar. To expedite the aging, each part was plated for about 2 hours before removal. The electrolyte was analyzed and replenished every 10-15 AH/L. The electrolyte demonstrated good solution stability during the aging test (75 AH/L, 5 MTOs). In addition, the appearance of the deposit, plating rate, efficiency, and alloy composition all remained constant.

Figure 4:
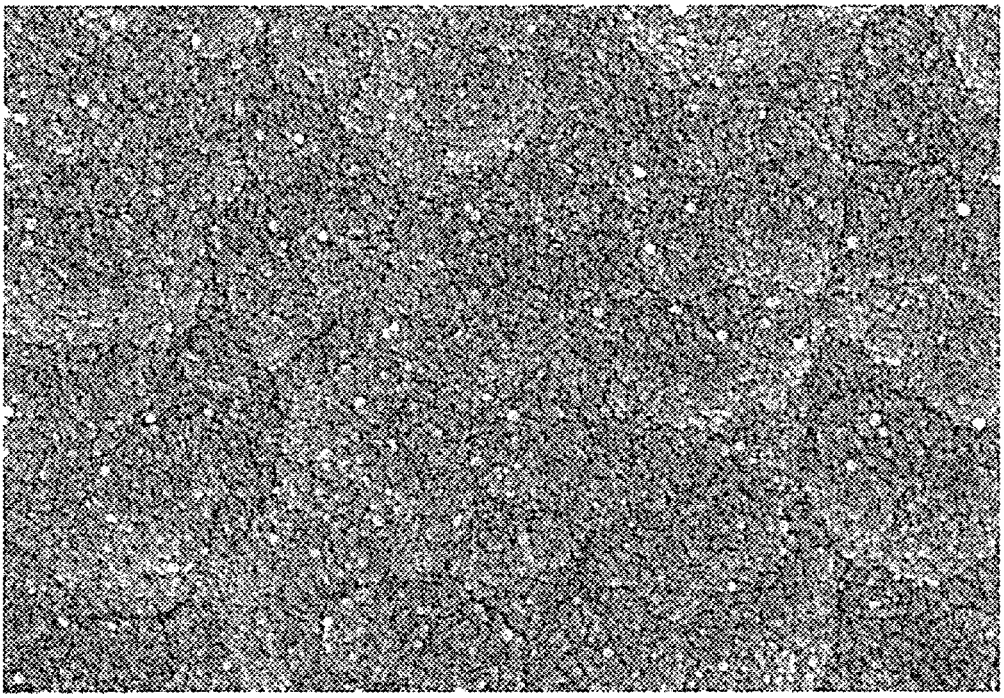
FIG. 4 depicts an SEM image of a silver/tin alloy deposited using the electrolyte of Example 1.
Figure 5:
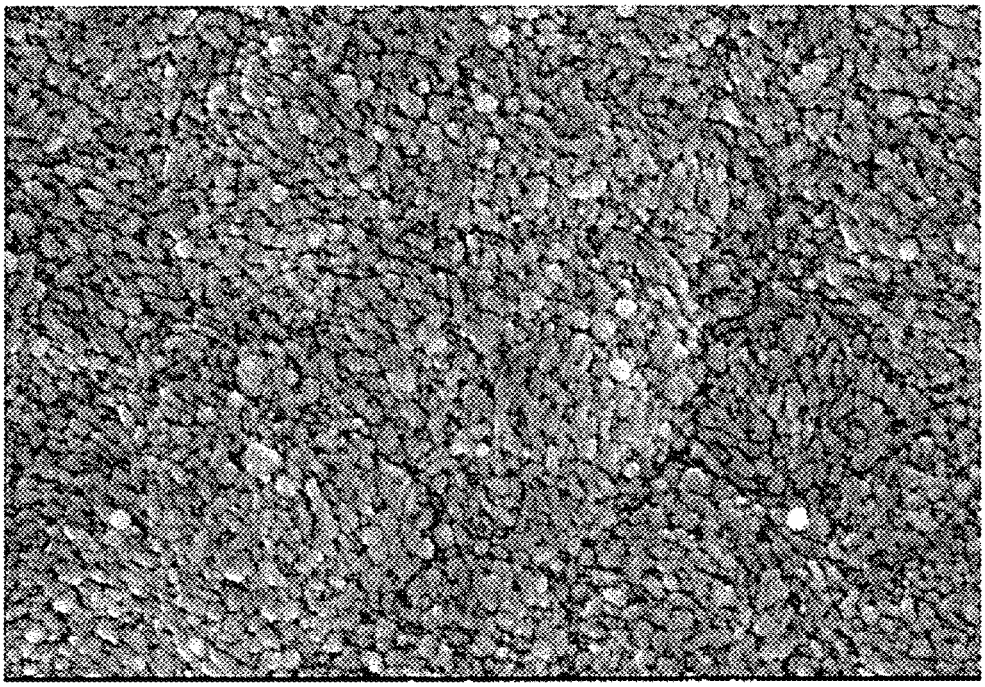
FIG. 5 depicts another SEM image of a silver/tin alloy deposited using the electrolyte of Example 1.

SEM images of silver/tin surface morphology are shown in FIGS. 4 and 5. As seen in FIGS. 4 and 5, the surface exhibited a micro-grain structure within a 2 μm size and that was pit and nodule free.

Figure 6:
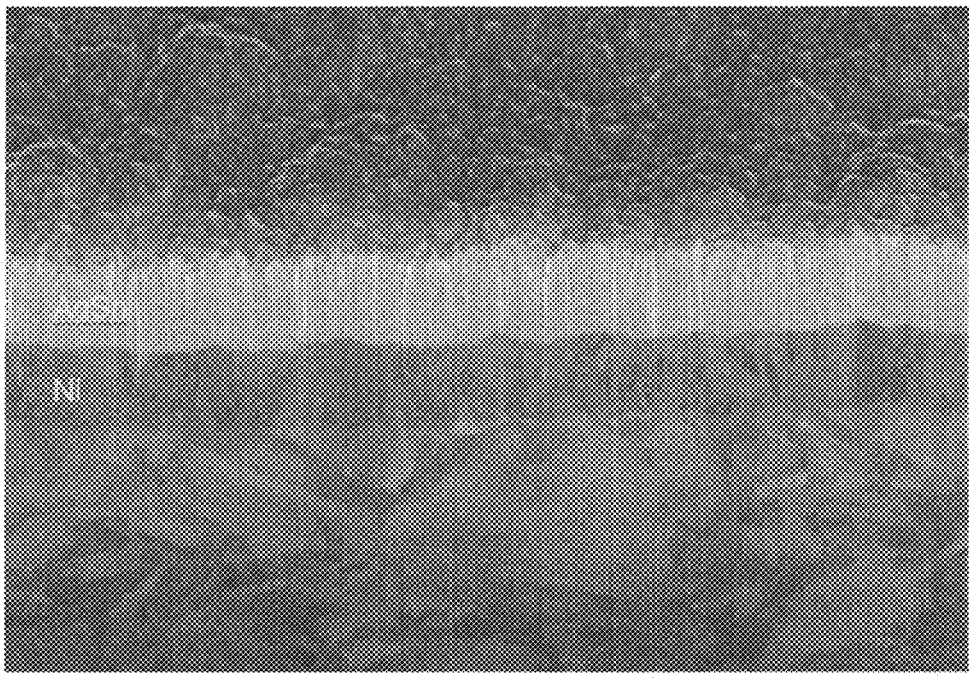
FIG. 6 depicts a view of a focused ion beam (FIB) cross-section of a silver/tin alloy deposited using the electrolyte of Example 1.
Figure 7:
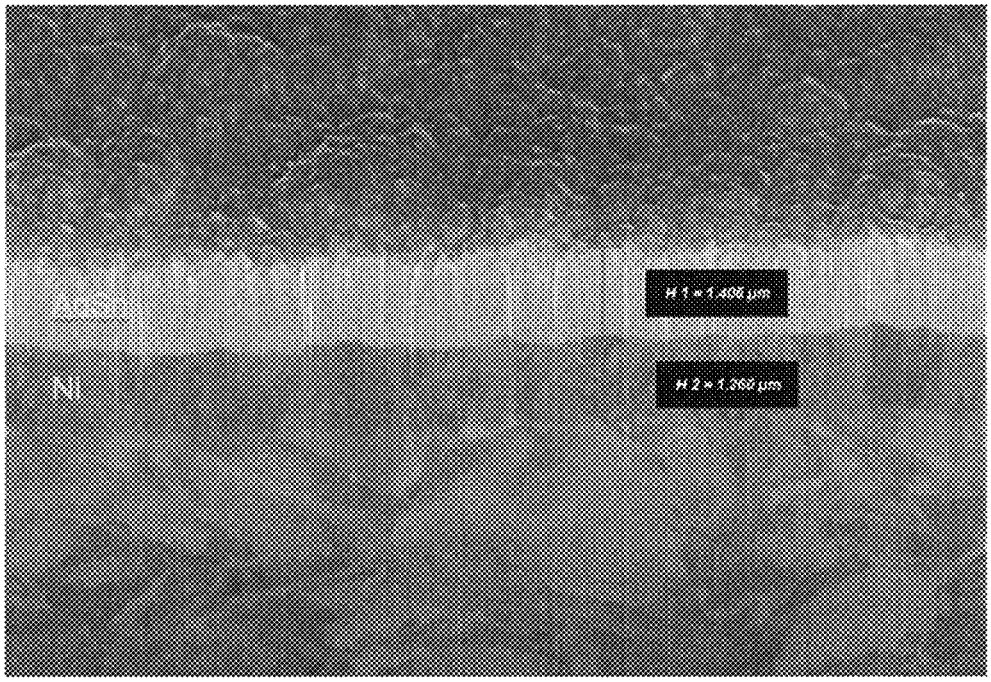
FIG. 7 depicts another view of a focused ion beam (FIB) cross-section of a silver/tin alloy deposited using the electrolyte of Example 1.

FIGS. 6 and 7 depict views of a focused ion beam (FIB) cross-section of a silver/tin alloy deposited using the electrolyte of Example 1. As seen from the figures, the deposit was even and pore free.

Comparative Example 1

As a comparison, a silver/tin electroplating bath was prepared with only one 3,6-dithiaoctane-1,8-diol as the complexing agent as shown in Table 2:

TABLE 2

| Component | Amount |
|---|---|
| Silver ions (from silver methane sulfonate) | 40.0 g/L |
| Tin ions (from tin methane sulfonate) | 15.0 g/L |
| Methane sulfonic acid (70 wt. %) | 50 ml/L |
| 3,6-dithiaoctane-1,8-diol | 150 g/L |
| Pyrocatechol | 1.65 g/L |
| UCON 50-HB-100 | 7.70 ml/L |
| Water | Balance |

Figure 8:
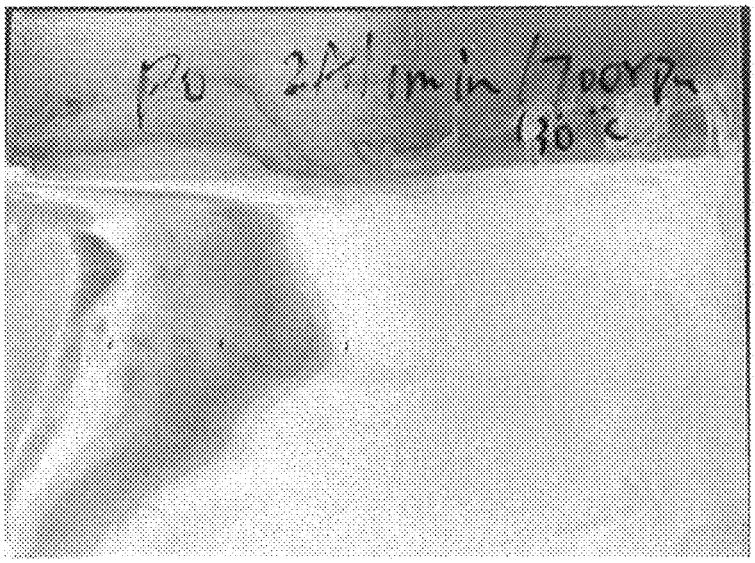
FIG. 8 depicts a view of a silver/tin alloy deposit on a substrate in accordance with Comparative Example 1.

As shown in FIG. 8, when only 3,6-dithiaoctane-1,8-diol was used as the complexing agent, nodules were observed in the plated deposit when viewed under a microscope.

Table 3 shows the effect of current density on thickness and the Ag/Sn ratio.

TABLE 3

| C.D. (ASF) | 80 | 50 | 30 |
|---|---|---|---|
| Thickness (μm) | 3.9 | 2.6 | 1.8 |
| Ag/Sn atomic ratio | 83/17 | 93/7 | 99/1 |

Example 2

The results of Comparative Example 1 were repeated with the addition of thiourea as a second complexing agent and a silver/tin electroplating bath was prepared containing 3,6-dithiaoctane-1,8-diol and thiourea as the complexing agents as shown in Table 4:

TABLE 4

| Component | Amount | Amount |
|---|---|---|
| Silver ions (from silver methane sulfonate) | 40.0 g/L | 40.0 g/L |
| Tin ions (from tin methane sulfonate) | 15.0 g/L | 15.0 g/L |
| Methane sulfonic acid (70 wt. %) | 50 ml/L | 50 ml/L |
| 3,6-dithiaoctane-1,8-diol | 150 g/L | 150 g/L |
| Thiourea | 6.6 g/L | 17.80 g/L |
| Pyrocatechol | 1.65 g/L | 1.65 g/L |
| UCON 50-HB-100 | 7.70 ml/L | 7.70 ml/L |
| Water | Balance | Balance |

Figure 9:
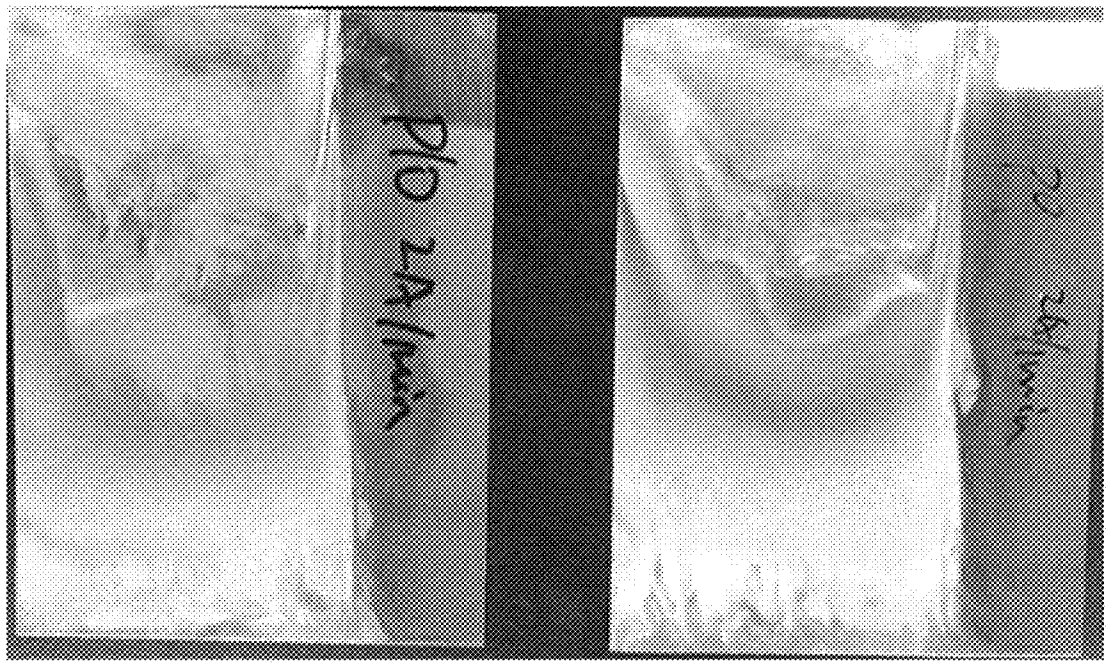
FIG. 9 depicts a view of a silver/tin alloy deposit on a substrate in accordance with Example 2 and using thiourea as the second complexing agent.

As shown in FIG. 9, for a hull cell panel plated at 2 A/1 min at 30° C., when thiourea was used as the second complexing agent, nodules were still observed in the plated deposit when viewed under a microscope. However, the Ag/Sn alloy composition is maintained closer to 80/20 ratio in the 50 ASF to 80 ASF range as compared to FIG. 8 where there is no second complexing agent, as shown in Table 5. Even when a larger concentration of thiourea was used as the second complexing agent, a stable Ag/Sn alloy composition is maintained. Table 5 shows the effect of current density on thickness and the Ag/Sn ratio for the composition containing 6.6 g/L of thiourea.

TABLE 5

| C.D. (ASF) | 80 | 50 | 30 |
|---|---|---|---|
| 6.6 g/L thiourea | | | |
| Thickness (μm) | 1.9 | 2.0 | 0.4 |
| Ag/Sn atomic ratio | 83/17 | 82/18 | 97/3 |
| 17.80 g/L thiourea | | | |
| Thickness (μm) | 2.6 | 1.5 | 0.4 |
| Ag/Sn atomic ratio | 82/18 | 79/21 | 96/4 |

Example 3

The results of Example 1 were repeated with several complexing agents of the allylthiourea family as shown below in Table 6.

TABLE 6

| Component | Amount | Amount | Amount |
|---|---|---|---|
| Silver ions (from silver methane sulfonate) | 40.0 g/L | 40.0 g/L | 40.0 g/L |
| Tin ions (from tin methane sulfonate) | 15.0 g/L | 15.0 g/L | 15.0 g/L |
| Methane sulfonic acid (70 wt. %) | 50 ml/L | 50 ml/L | 50 ml/L |

TABLE 6-continued

| Component | Amount | Amount | Amount |
|---|---|---|---|
| 3,6-dithiaoctane-1,8-diol | 150 g/L | 150 g/L | 150 g/L |
| Thiodiglycol | | | 50 ml/L |
| Ally-thiourea | 6.6 g/L | 13.30 g/L | 13.30 g/L |
| Pyrocatechol | 1.65 g/L | 1.65 g/L | 1.65 g/L |
| UCON 50-HB-100 | 7.70 ml/L | 7.70 ml/L | 7.70 ml/L |
| Water | Balance | Balance | Balance |

Figure 10:
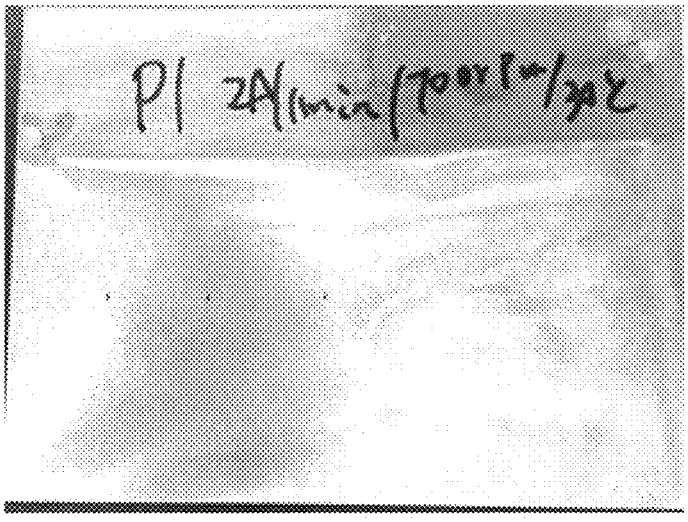
FIG. 10 depicts a view of a silver tin alloy deposit on a substrate in accordance with Example 3 and using allylthiourea as the second complexing agent.
Figure 11:
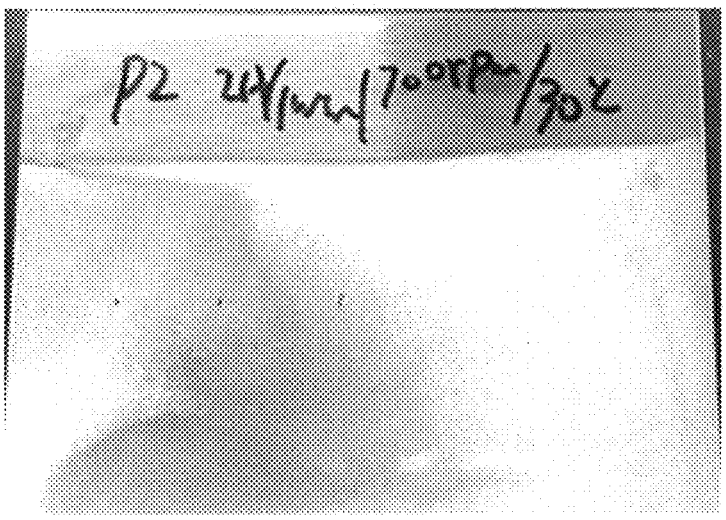
FIG. 11 depicts a view of a silver tin alloy deposit on a substrate in accordance with Example 3 and using a different concentration of allyl-thiourea as the second complexing agent.
Figure 12:
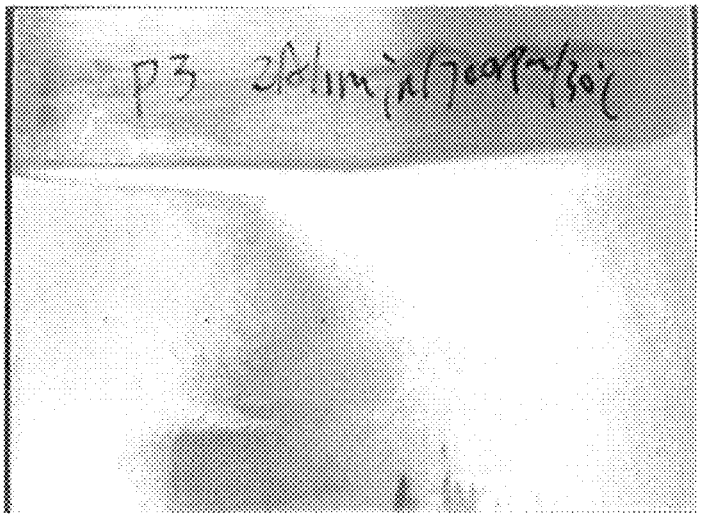
FIG. 12 depicts a view of a silver tin alloy deposit on a substrate in accordance with Example 3 and using allylthiourea as the second complexing agent along with thiodiglycol.

As shown in FIGS. 10, 11, and 12, when Allyl-thiourea was used as second complexing agent, the optical appearance of hull cell panel (plated at 2 A/1 min at 30° C.) is improved. Additionally, fewer nodules were seen under the microscope. By increasing the amount of Allyl-thiourea from 6.6 g/L to 13.3 g/L, the Ag/Sn ratio becomes more consistent between 50 ASF and 80 ASF as shown in Table 7. Adding a second first complexing agent (i.e., thiodiglycol) maintained the good appearance and Ag/Sn alloy ratio consistency. Table 7 shows the effect of current density on thickness and the Ag/Sn ratio.

TABLE 7

| C.D. (ASF) | 80 | 50 | 30 |
|---|---|---|---|
| 6.6 g/L allyl-thiourea | | | |
| Thickness (μm) | 3.8 | 2.1 | 1.6 |
| Ag/Sn atomic ratio | 76/24 | 91/9 | 95/5 |
| 13.3 g/L allyl-thiourea | | | |
| Thickness (μm) | 3.8 | 2.2 | 1.5 |
| Ag/Sn atomic ratio | 78/22 | 86/14 | 94/6 |
| Allyl-thiourea + thiodiglycol | | | |
| Thickness (μm) | 3.5 | 2.6 | 1.4 |
| Ag/Sn atomic ratio | 74/26 | 77/23 | 93/7 |

Example 4

The results of Example 1 were repeated with several complexing agents of the aryl- and alkyl-thiourea families as shown below in Table 6.

TABLE 8

| Component | Amount | Amount | Amount |
|---|---|---|---|
| Silver ions (from silver methane sulfonate) | 40.00 g/L | 40.00 g/L | 40.00 g/L |
| Tin ions (from tin methane sulfonate) | 15.00 g/L | 22.50 g/L | 22.50 g/L |
| Methane sulfonic acid (70 wt. %) | 50.00 ml/L | 50.00 ml/L | 50.00 ml/L |
| 3,6-dithiaoctane-1,8-diol | 150.00 g/L | 150.00 g/L | 150.00 g/L |
| Phenylthiourea | 4.00 g/L | 4.00 g/L | |
| N,N'-dimethylthiourea | | | 4.00 g/L |
| Pyrocatechol | 1.65 g/L | 1.65 g/L | 1.65 g/L |
| UCON 50-HB-100 | 7.70 ml/L | 7.70 ml/L | 7.70 ml/L |
| Water | Balance | Balance | Balance |

Figure 13:
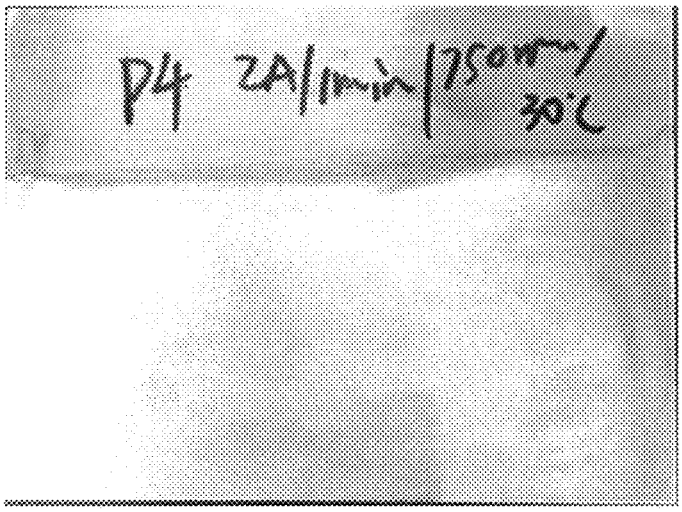
FIG. 13 depicts a view of a silver tin alloy deposit on a substrate in accordance with Example 4 and using phenylthiourea as the second complexing agent.
Figure 14:
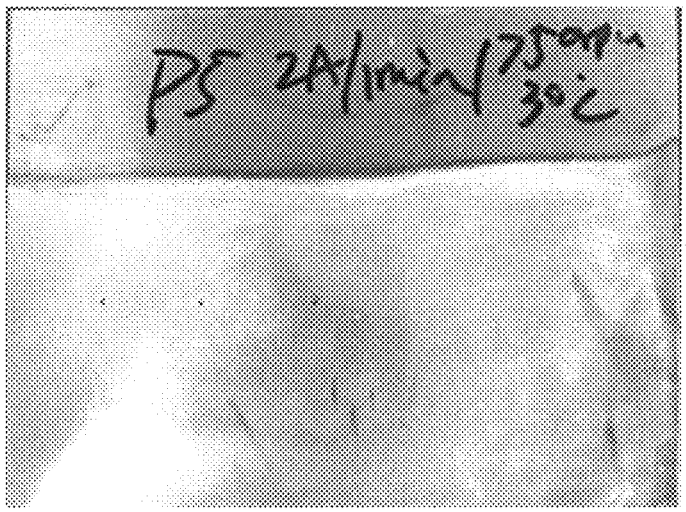
FIG. 14 depicts a view of a silver tin alloy deposit on a substrate in accordance with Example 4 and using a different concentration of phenylthiourea as the second complexing agent.
Figure 15:
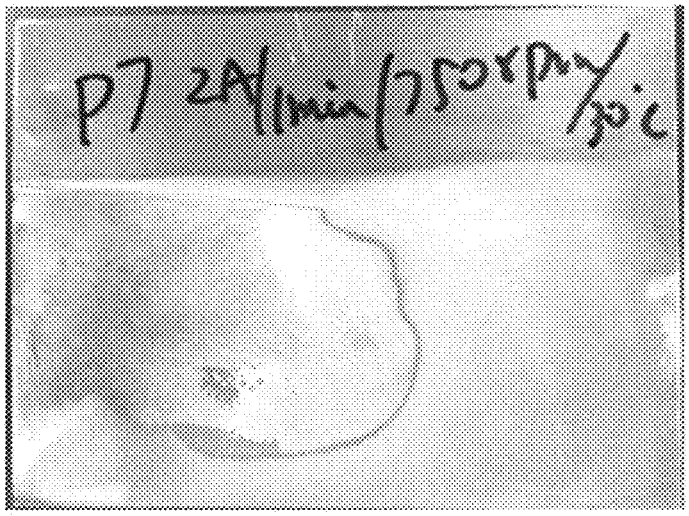
FIG. 15 depicts a view of a silver tin alloy deposit on a substrate in accordance with Example 3 and using N,N'-dimethylthiourea as the second complexing agent.

Phenylthiourea (FIGS. 13 and 14) and N,N'-dimethylthiourea (FIG. 15) were also studied by plating hull cell panels at 2 A/1 minute at 30° C. additionally, two tin metal levels were tested between 15 g/L (FIG. 13) and 22.5 g/L (FIG. 14). With increasing tin metal levels, the optical appearance remained similar, and Ag/Sn ratio decreased slightly in higher tin bath as expected, as shown in Table 9. Replacing N,N'-dimethylthiourea for phenylthiourea did not produce a significant change in the Ag/Sn ratio.

Table 9 shows the effect of current density on thickness and the Ag/Sn ratio.

TABLE 9

| C.D. (ASF) | 80 | 50 | 30 |
|---|---|---|---|
| 4.0 g/L phenylthiourea | | | |
| Thickness (μm) | 3.9 | 2.3 | 1.3 |
| Ag/Sn atomic ratio | 83/17 | 85/15 | 91/9 |
| 4.0 g/L phenyl thiourea + 22.5 g/L tin (MSA) | | | |
| Thickness (μm) | 3.8 | 2.5 | 1.7 |
| Ag/Sn atomic ratio | 67/33 | 79/21 | 91/9 |
| 4.0 g/L N,N'-dimethylthiourea + 22.5 g/L tin (MSA) | | | |
| Thickness (μm) | 4.3 | 2.4 | 0.5 |
| Ag/Sn atomic ratio | 63/37 | 71/29 | 86/14 |
| Water | | Balance | |

As seen from the examples, the use of the electrolyte described herein was able to provide an AgSn deposit exhibiting a satin white appearance, with very fine grains. The deposit exhibited a pore-free close packed coating structure. In addition, no free tin was detected by XRD analysis in the AgSn deposit. In each of the examples, the electrolyte maintained a high cathode efficiency from 2.5 ASD to 12.5 ASD and exhibited good solution stability. Finally, no whiskering was observed.

Finally, it should also be understood that the following claims are intended to cover all of the generic and specific features of the invention described herein and all statements of the scope of the invention that as a matter of language might fall there between.

What is claimed is:

1. An electroplating bath composition comprising:

a) a source of silver ions;

b) a source of tin ions;

c) an acid;

d) a first complexing agent, wherein the first complexing agent is a dihydroxy bis-sulfide compound selected from the group consisting of 2,4-dithia-1,5-pentanediol, 2,5-dithia-1,6-hexanediol, 2,6-dithia-1,7-heptanediol, 2,7-dithia-1,8-octanediol, 2,8-dithia-1,9-nonanediol, 2,9-dithia-1,10-decanediol, 2,11-dithia-1,12-dodecanediol 5,8-dithia-1,12-dodecanediol 2,15-dithia-1,16-hexadecanediol, 2,21-dithia-1,22-doeicasanediol, 3,5-dithia-1,7-heptanediol, 3,6-dithia-1,8-octanediol, 3,8-dithia-1,10-decanediol, 3,10-dithia-1,8-(dodecanediol, 3,13-dithia-1,15-pentadecanediol, 3,18-dithia-1,20-eicosanediol, 4,6-dithia-1,9-nonanediol, 4,7-dithia-1,10-decanediol, 4,11-dithia-1,14-tetradecanediol, 4,15-dithia-1,18-octadecanediol, 4,19-dithia-1,22-dodeicosanediol, 5,7-dithia-1,1'-undecanediol, 5,9-dithia-1,13-tridecanediol, 5,13-dithia-1,17-heptadecanediol, 5,17-dithia-1,2'-uneicosanediol, 1,8-dimethyl-3,6-dithia-1,8-octanediol, and combinations of one or more of the forgoing;

e) a second complexing agent, wherein the second complexing agent is a thiourea selected from the group consisting of allyl thioureas, aryl thioureas, and alkyl thioureas, and combinations thereof; and f) optionally, a wetting agent; and g) optionally, an antioxidant.

2. The electroplating bath according to claim 1, wherein the source of silver ions is selected from the group consisting of silver halides, silver gluconate, silver citrate, silver lactate, silver nitrate, silver sulfates, silver alkane sulfonates and silver alkanol sulfonates.

3. The electroplating bath according to claim 1, wherein the source of tin ions is selected from the group consisting of tin halides, tin sulfates, tin alkane sulfonates, and tin alkanol sulfonates.

4. The electroplating bath according to claim 1, wherein the acid is selected from the group consisting of methane sulfonic acid, ethane sulfonic acid and propane sulfonic acid, phenyl sulfonic acid, tolyl sulfonic acid, sulfuric acid, sulfamic acid, hydrochloric acid, hydrobromic acid and fluoroboric acid.

5. The electroplating bath according to claim 1, wherein the source of silver ions is silver methane sulfonate, the source of tin ions is tin methane sulfonate, and the acid is methane sulfonic acid.

6. The electroplating bath according to claim 1, wherein the first complexing agent comprises 3,6-dithia-1,8-octanediol.

7. The electroplating bath according to claim 1, wherein the second complexing agent is selected from the group consisting of N-Allyl-N'-(2-hydroxyethyl)thiourea, Allylthiourea, phenylthiourea, N,N'-dimethylthiourea, and combinations of one or more of the foregoing.

8. The electroplating bath according to claim 1, wherein a reducing agent is present in the bath and is selected from the group consisting of hydroquinone, hydroquinone sulfonic acid, potassium salt and hydroxylated aromatic compounds.

9. The electroplating bath according to claim 1, wherein the electroplating bath is configured to deposit a silver/tin alloy on a substrate containing at least 70% silver.

10. The electroplating bath according to claim 9, wherein the electroplating bath is configured to deposit a silver tin alloy on a substrate containing between 70% to 95% silver.

11. The electroplating bath according to claim 1, wherein the bath is maintained at a pH of less than about 5.

12. The electroplating bath according to claim 1, wherein the bath is maintained at a temperature in the range of about room temperature to about 55° C.

13. A method of electroplating a silver/tin alloy onto the surface of a substrate, the method comprising the steps of:

a) contacting the surface of the substrate with a silver/tin electroplating bath comprising:

i) a source of silver ions;

ii) a source of tin ions;

iii) an acid;

iv) a first complexing agent, wherein the first complexing agent is a dihydroxy bis-sulfide compound selected from the group consisting of 2,4-dithia-1,5-pentanediol, 2,5-dithia-1,6-hexanediol, 2,6-dithia-1,7-heptanediol, 2,7-dithia-1,8-octanediol, 2,8-dithia-1,9-nonanediol, 2,9-dithia-1,10-decanediol, 2,11-dithia-1,12-dodecanediol, 5,8-dithia-1,12-dodecanedial, 2,15-dithia-1,16-hexadecanediol, 2,21-dithia-1,22-doeicasanediol, 3,5-dithia-1,7-heptanediol, 3,6-dithia-1,8-octanediol, 3,8-dithia-1,10-decanediol, 3,10-dithia-1,8-(dodecanediol, 3,13-dithia-1,15-pentadecanediol, 3,18-dithia-1,20-eicosanediol, 4,6-dithia-1,9-nonanediol, 4,7-dithia-1,10-decanediol, 4,11-dithia-1,14-tetradecanediol, 4,15-dithia-1,18-octadecanediol, 4,19-dithia-1,22-dodeicosanediol, 5,7-dithia-1,1'-undecanediol, 5,9-dithia-1,13-tridecanediol, 5,13-dithia-1,17-heptadecanediol, 5,17-dithia-1,2'-uneicosanediol, 1,8-dimethyl-3,6-dithia-1,8-octanediol, and combinations of one or more of the forgoing;

v) a second complexing agent, wherein the second complexing agent is selected from the group consisting of allyl thioureas, aryl thioureas, and alkyl thioureas, and combinations thereof; and vi) optionally, a wetting agent; and vii) optionally, an antioxidant;

wherein the electroplating bath deposits a silver/tin alloy on the surface of the substrate.

14. The process according to claim 13, wherein the substrate comprises nickel.

15. A method of electroplating a silver/tin alloy onto the surface of a connector, wherein the connector is plated with a nickel barrier layer, the method comprising the steps of:

a) contacting the connector with the nickel barrier layer thereon with a silver/tin electrolyte, the electrolyte comprising:

i) a source of silver ions;

ii) a source of tin ions;

iii) an acid;

iv) a first complexing agent, wherein the first complexing agent is a dihydroxy bis-sulfide compound selected from the group consisting of 2,4-dithia-1,5-pentanediol, 2,5-dithia-1,6-hexanediol, 2,6-dithia-1,7-heptanediol, 2,7-dithia-1,8-octanediol, 2,8-dithia-1,9-nonanediol, 2,9-dithia-1,10-decanediol, 2,11-dithia-1,12-dodecanediol, 5,8-dithia-1,12-dodecanediol, 2,15-dithia-1,16-hexadecanediol, 2,21-dithia-1,22-doeicasanediol, 3,5-dithia-1,7-heptanediol, 3,6-dithia-1,8-octanediol, 3,8-dithia-1,10-decanediol, 3,10-dithia-1,8-(dodecanediol, 3,13-dithia-1,15-pentadecanediol, 3,18-dithia-1,20-eicosanediol, 4,6-dithia-1,9-nonanediol, 4,7-dithia-1,10-decanediol, 4,11-dithia-1,14-tetradecanediol, 4,15-dithia-1,18-octadecanediol, 4,19-dithia-1,22-dodeicosanediol, 5,7-dithia-1,1'-undecanediol, 5,9-dithia-1,13-tridecanediol, 5,13-dithia-1,17-heptadecanediol, 5,17-dithia-1,2'-uneicosanediol, 1,8-dimethyl-3,6-dithia-1,8-octanediol, and combinations of one or more of the forgoing;

v) a second complexing agent, wherein the second complexing agent is selected from the group consisting of allyl thioureas, aryl thioureas, and alkyl thioureas, and combinations thereof; and vi) optionally, a wetting agent; and vii) optionally, an antioxidant;

wherein the electroplating bath deposits a silver/tin alloy on the surface of the connector.

16. The method according to claim 15, wherein the connector is a press fit pin.

17. The method according to claim 15, wherein the silver/tin alloy deposit exhibits a consistent alloy ratio of about 17-18 wt. % tin.

18. The method according to claim 15, wherein the silver/tin alloy deposit exhibits a satin white deposit color.

* * * * *